United States Patent [19]

Enomoto

[11] 4,030,804

[45] June 21, 1977

[54] ELECTRICAL TERMINAL

[75] Inventor: Masahiro Enomoto, Tokyo, Japan

[73] Assignee: AMP Incorporated, Harrisburg, Pa.

[22] Filed: July 13, 1976

[21] Appl. No.: 704,883

[30] Foreign Application Priority Data

Aug. 7, 1975 United Kingdom ..... 32967/75

[52] U.S. Cl. ..... 339/258 S

[51] Int. Cl.² ..... H01R 13/04

[58] Field of Search ..... 339/195, 196, 252, 256 SP, 339/258 S, 276 T

[56] References Cited

UNITED STATES PATENTS 2,511,806 6/1950 Macy ..... 339/276 T

FOREIGN PATENTS OR APPLICATIONS 2,246,988 5/1975 France ..... 339/256 SP

*Primary Examiner*—Joseph H. McGlynn

*Attorney, Agent, or Firm*—Allan B. Osborne

[57] ABSTRACT

A terminal has a mating tab formed into double thickness by folding over opposite longitudinal edge portions and a mounting portion of channel section behind the tab, forward ends of the channel walls being offset longitudinally in a transition region between the tab and mounting portion. Preferably one longitudinal edge portion of the tab has an extension behind the other edge portion.

2 Claims, 3 Drawing Figures

ELECTRICAL TERMINAL

The invention relates to electrical terminals.

An electrical terminal according to the invention is stamped and formed from a single piece of single thickness sheet metal stock and comprises a forward contact portion, a mounting portion and a rear wire connecting portion, the contact portion comprising a double thickness tab formed by folding over single thickness stock and the mounting portion being of channel section, forward ends of the channel walls being offset longitudinally of the terminal in a transition reigon between the contact portion and the mounting portion, one end extending forwardly of the tab rear and the other end terminating at the tab rear.

Preferably, the tab is formed by folding over opposite marginal edge portions of the stock, one marginal edge portion extending further rearwardly than the other to provide an extension of increased width protruding behind the other tab edge portion in the transition region and with the free edge of the extension adjacent the forward end of the one wall.

The invention includes a housing for the terminal and a connector comprising the terminal mounted in the housing.

An example of a terminal according to the invention and a housing therefor is shown in the accompanying drawings in which.

Figure 1:
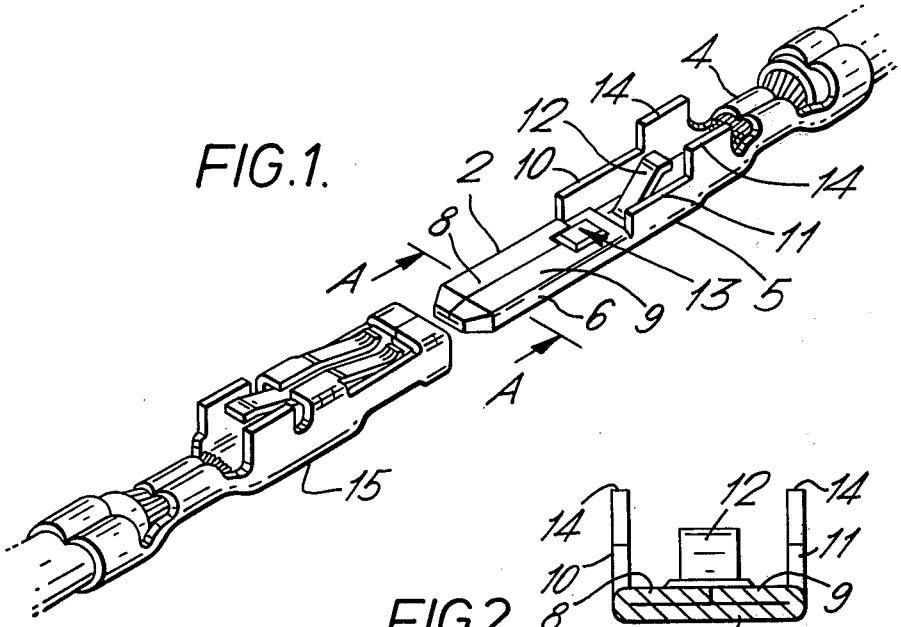
FIG. 1 is a perspective view of the terminal and a complementary female terminal.
Figure 2:
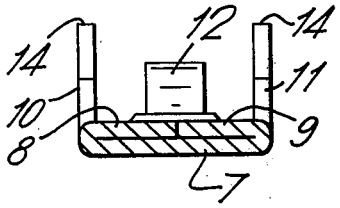
FIG. 2 is a cross-sectional view of the terminal taken along line A—A of FIG. 1, and, FIG. 3 is a perspective view of a housing partly cut away to show the terminal mounted therein.
Figure 3:
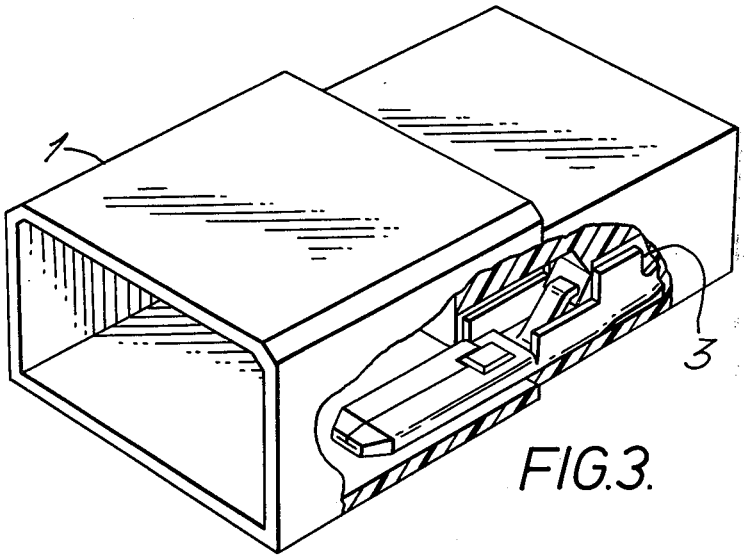

The terminal is stamped and formed from a single piece of single thickness sheet metal stock and comprises a contact portion 2, a mounting portion 5 extending rearwardly of the contact portion and a wire connecting portion 4 at the rear of the terminal.

The contact portion 2 comprises a tab formed into double thickness by folding over opposite marginal edge portions to provide upper and lower plates 8, 9 and 7, respecdtively. The plate 9 extends further rearwardly of the tab than the plate 8, into a transition region between the tab and mounting portion. The extension, hereinafter referred to as extension 13, is of increased width, extending, transversely of the tab behind the plate 8 to a location adjacent the opposite edge of the tab. The tab may be embossed in the transition region for strengthening purposes.

The mounting portion is formed into channel section having side walls 10 and 11 free edges of which are provided with vertical extensions 14 at locations towards the rear. A resilient retaining tongue 12 is struck from the base of the channel at a location between the side walls to extend rearwardly of the terminal. In the transition region, leading ends of the side walls are offset longitudinally of the terminal, the side wall 10 extending to the end of plate 8 adjacent to the free ends of extension 13 and the side wall 11 terminating at the rear of the plate 9.

The wire connecting portion 4 comprises conventional core and insulation engaging crimping ferrules.

The longitudinal offset or stagger of the leading ends of the side walls together with the provision of the extension 13 strengthens the transition region between the connecting and mounting portions.

A housing for the terminal is moulded in one piece from insulating material and includes a forward cavity of increased cross-sectional size to receive a complementary plug housing from which cavity extend a series of terminal-receiving cavities communicating with the housing rear. A rearwardly extending ramp is provided at a central location on a ceililng of each terminal-receiving cavity and has a forward face formed with a locking shoulder for engagement with the locking tongue 12 to provide withdrawl of the terminal from the cavity. The floor is also provided with a ramp at a location opposite the ceiling ramp. Opposite edges of the ceiling may be formed with grooves having blind ends for engagement with the stops.

The terminal is inserted into the cavity from a rear of the housing and during insertion the side walls pass on opposite sides of the ceiling ramp which deflects the locking tongue while the floor ramp elevates the terminal. On further insertion, the free end of the tongue snaps behind the shoulder and the side wall extensions engage the blind end of the grooves to prevent over insertion.

As the transition region is strengthened the terminal is resistant to bending about a transverse axis and therefore is particularly suitable for free hanging, (wire to wire) and other applications where such bending stresses are likely to occur.

The tab of contact portion 2 is adapted to be telescopingly received in receptacle 15 (FIG. 1) or the like.

The foregoing detailed description has been given for clearness of understanding only, and no unnecessary limitations should be understood therefrom, as some modifications will be obvious to those skilled in the art.

What is claimed is:

1. An electrical terminal stamped and formed from a single piece of single thickness sheet metal stock comprising a forward contact portion, a mounting portion and a rear wire connecting portion, the contact portion comprising a double thickness tab formed by folding over single thickness stock and the mounting portion being of channel section, forward ends of the channel walls being offset longitudinally of the terminal in a transition region between the contact portion and the mounting portion, one end extending forwardly of the tab rear and the other end terminating at the tab rear.

2. An electrical terminal of claim 1 in which the tab is formed by folding over opposite marginal edge portions of the stock, one marginal edge portion extending further rearwardly than the other to provide an extension of increased width protruding behind the other tab edge portion in the transition region and with the free edge of the extension adjacent the forward end of the one wall.

* * * * *